United States Patent [19]

Ginzburg

[11] Patent Number: 4,757,746

[45] Date of Patent: Jul. 19, 1988

[54] METHOD OF AND APPARATUS FOR CONTROL OF A FORCE APPLIED TO OR THE POSITION ASSUMED BY A WORK EFFECTING ELEMENT

[75] Inventor: Vladimir B. Ginzburg, Pittsburgh, Pa.

[73] Assignees: United Engineering, Inc.; International Rolling Mill Consultants, Inc., both of Pittsburgh, Pa.

[21] Appl. No.: 89,421

[22] Filed: Aug. 26, 1987

[51] Int. Cl.[4] ..... F15B 13/16

[52] U.S. Cl. ..... 91/361; 91/429

[58] Field of Search ..... 91/361, 519, 429, 508, 91/170 MP, 430

[56] References Cited

U.S. PATENT DOCUMENTS

| | | | |
|---|---|---|---|
| 3,242,822 | 3/1966 | Barltrop | 91/361 X |
| 3,402,737 | 9/1968 | Goldstein | 91/461 X |
| 3,709,253 | 1/1973 | Spangenberg | 91/429 X |
| 4,072,353 | 2/1978 | Clark et al. | 299/22 |
| 4,527,954 | 7/1985 | Murali et al. | 91/363 R |

*Primary Examiner*—Edward K. Look

*Attorney, Agent, or Firm*—Daniel Patch

[57] ABSTRACT

A control for a press for controlling the flow of fluid to two hydraulic actuators which applies a desired working force to or which positions the press platen in a desired position including a sub-control for introducing first and second super-imposed oscillations on the fluid of the actuators of equal amplitude and opposite phase to reduce internal friction in the actuators without disturbing the desired applied force or position of the platen.

6 Claims, 2 Drawing Sheets

METHOD OF AND APPARATUS FOR CONTROL OF A FORCE APPLIED TO OR THE POSITION ASSUMED BY A WORK EFFECTING ELEMENT

BACKGROUND OF THE INVENTION

In the use of fluid actuators employed to position parts of machinery or to employ the machine parts to resist or apply a working force in the operation of the machines to effect a given result there has existed undesirable inherent mechanical frictional forces between the moving elements of the actuators that adversely affects the desired result.

In an attempt to overcome the adverse affect of such frictional forces it has been suggested to introduce low amplitude continuous oscillations in the fluid being fed to the actuators to minimize the frictional forces from preventing control of the movement, speed and position of the moving element of the actuator and hence the part or parts of the machine with which they are associated. An example, in part, of such attempts may be found in Russian Patent Publications SU No. 617,089 dated 7/4/78 and SU No. 686,704 dated 9/25/79. In the systems of these publications the vibrations or oscillations in the vertical or horizontal directions are introduced into the fluid piston cylinder assemblies during rolling to reduce the rolling forces otherwise required and/or to better regulate the thickness of the rolled product.

These systems while representing an improvement in reducing the affects of the frictional forces, introduce another problem in that the continuous oscillating forces prevent accurate control of the desired resisting or applied force or positioning of the working element of the machine, in the above illustrated case a rolling mill. The degree of the amplitude of the oscillating forces represent a force or position greater and less than the desired force or position of the working element which in a given case can be very objectionable, for example, in a workpiece reducing element such as a platen of a press the reduced workpiece will have a varying thickness instead of a constant thickness.

The present invention relates to a method and apparatus for obtaining optimum control both in speed and accuracy of hydraulic actuators used, for example, to apply or resist a working force of machine parts or to control the distance vetween working parts of a machine. While it will be readily appreciated that the present invention will have utility in any fluid applications employing fluid actuators, for the purpose of describing the invention its use in an hydraulic press has been selected.

In this application multiple oscillation forces are introduced into the actuator means, for example several press platen piston cylinder assemblies, in opposite directions at substantially to same amplitude and in opposite phase.

More particular, instead of having an unidirectional piston cylinder assembly for controlling the force or positioning between the work effecting part two or more piston cylinder assemblies are employed, similarly positioned, in which the two assemblies or other combination of sets are arranged to produce opposing oscillations in the applied or resisting force of equal amplitude and in opposite phase and in a manner that the oscillations will not only minimize the friction forces in the piston cylinder assemblies but will not affect the critical positioning of the working parts or the application of the desired force applied by them.

In one form the invention provides a method and apparatus of operating a machine having a work effecting element, wherein the element is designed to either apply, maintain or re-establish a desired position and wherein the element is connected to and is moved by a fluid actuator means which is subject to internal undesirable affects of friction, comprising method and means for controlling the flow of fluid to the means to obtain the desired force or position of said element, imposing controlled first oscillations on the fluid in a manner to reduce the frictional forces and, substantially simultaneous which the first oscillations imposing second controlled oscillations on the fluid of substantially the same amplitude and substantially opposite in phase to the first oscillations to reduce the first oscillations disturbing the desired force or position of the element obtained through the actuator means.

BRIEF DESCRIPTION OF THE DRAWINGS

These and other features of the invention will be better understood when the following description of the preferred embodiment is read alone with the accompanying drawings of which.

DETAILED DESCRIPTION OF THE PREFERRED EMBODIMENTS

Figure 1:
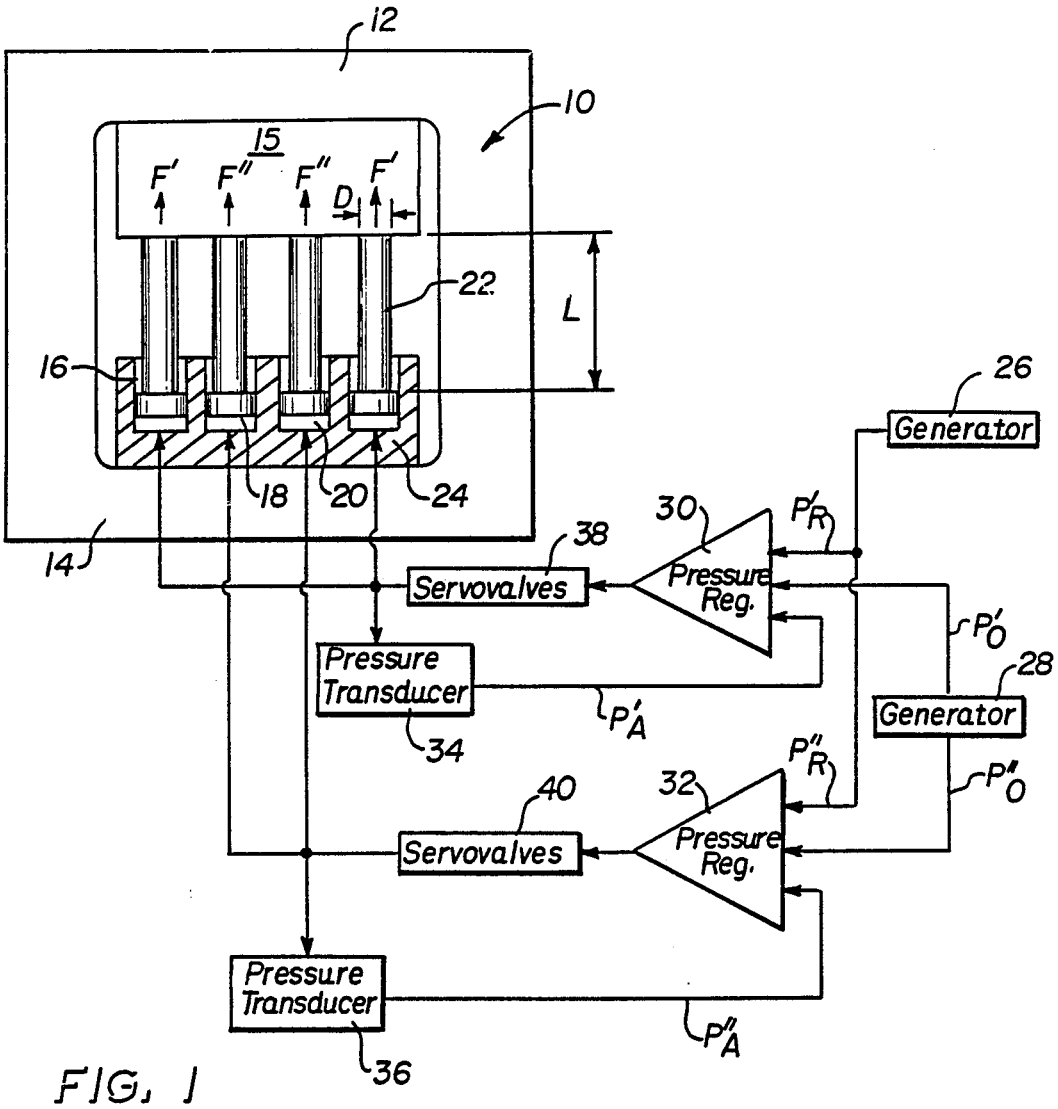
FIG. 1 is a schematic elevational view of of a press incorporating one embodiment of the present invention.

With reference to FIG. 1 there is schematically shown a forging metal press, which since the basic components are well known in the art and a description is not necessary to an understanding of the invention they will only be briefly referred to. In FIG. 1 there is shown an outer frame 10 for receiving and containing the working force applied to the two upper and lower separator portions 12 and 14 thereof by the vertically moveable platen 15. The platen 15 is advanced toward and away from the upper separator 12 by a series of parallel arranged piston cylinder assemblies 16, 18, 20 and 22 extending between the two separators 12 and 14 and having their pistons received in a base member 24 carried by the lower separator 14.

In the illustrated form, the piston cylinder assemblies have the same inside diameters, and in fact are identical except that cylinders 16 and 22 provide a separating force $F_R'$ and the cylinders 18 and 20 a separating force $F_R''$.

In one design application the piston cylinder assemblies operate at average pressures of 3000 psi and with amplitude of oscillating component of pressure about 60 psi and frequency in excess of $5H_z$. In the arrangement shown the force of the four cylinders are additive so that the force on the platen 15 is the total force exerted by two sets of cylinders.

The control of the piston cylinder assemblies is also shown in FIG. 1 and schematically comprises two electrical signal generators 26 and 28 for producing signals representing the cylinder pressures of equal values $P_R'=P_R''$ and $P_O'=P_O''$, respectively. These signals are sent to two pressure regulators 30 and 32 (combined control and power amplifiers) which also receive individual electrical feedback signals from pressure transducers 34 and 36 that measure the pressure of the associated set of piston cylinder assemblies, these signals being represented in FIG. 1 by the symbols $P_A'$ and $P_A''$, respectively.

The regulators 30 and 32 feed their signals to individual servovalves 38 and 40, the valve 38 being connected to piston cylinder assemblies 16 and 22 and the valve 40 to the piston cylinder assemblies 18 and 20. It will be obvious to those skilled in the art that the various components identified of the control are well known and the control system is a closed loop type. While the preferred medium of the above described fluid system is oil, it will be appreciated that the system could employ other medium such as grease as used in the press and rolling mill art.

Considering the control designed for an oil system the electrohydraulic servovalves 38 and 40 can be of the type supplied by the Moog Incroporated for industrial use such as High Flow Two-Stage Serial 72 which are capable of both controlling the desired operating force for the press and also super-imposing oscillations of pressure in each cylinder set within a desired range for example ±10 to ±100 psi.

The other components of the control, i.e. the transducers, regulators and generators are industrial type units of the type used for presses and rolling mills and the like as supplied by General Electric Company. Those skilled in the art will also appreciate that the usual well known fluid system components and controls i.e. pump system, fluid storage and valve network have not been illustrated. It will also be recognized that part of the control system which will include some of the electrical components identified will include an industrial type microprocessor, such as supplied by General Electric Company.

In referring now to the operation of the control system of FIG. 1 the nominal pressure references $P_R'$ and $P_R''$ will provide the working force F' generated by cylinders 16 and 22 to be equal to F'' that generated by cylinders 18 and 20. In the case when all four cylinders are of the same size $P_R'=P_R''$ and $F'=F''$. When oscillating pressure references $P_O'$ and $P_O''$ are applied, the cylinders 16–22 and 18–20 will generate additional cyclic working forces $F_O'$ and $F_O''$ which are generally of the same amplitude and opposite in phase. The applitude and phase being established by the generator 28. As a result, the total working force applied to the platen 15 stays equal to the nominal value. Assuming that the frame 10 is much more rigid than the piston rods, the compression of each piston rod due to the oscillating forces is equal to $$L_o = \frac{4 \cdot L \cdot P_o}{\pi \cdot d \cdot 2 \cdot E}$$

Where
L=Length of the Piston Rod
d=Diameter of the piston rod
E=Modulus of elasticity
When
$P_O$=20,000 lb, L=20 in., d=4.0 in.
E=30,000,000 lb/sq. in.
In substituting these values in the above equation we have:

$$L_o = \frac{4 \cdot (20) \cdot (20{,}000)}{\pi \cdot (4)^2 \cdot (30{,}000{,}000)} = 0.001 \text{ in.}$$

Therefore the pistons would oscillate ±0.001 in. and the oscillating displacement will substantially reduce the frictional forces between the pistons and cylinders, but yet not distrub the desired platen position or desired working pressure.

Figure 2:
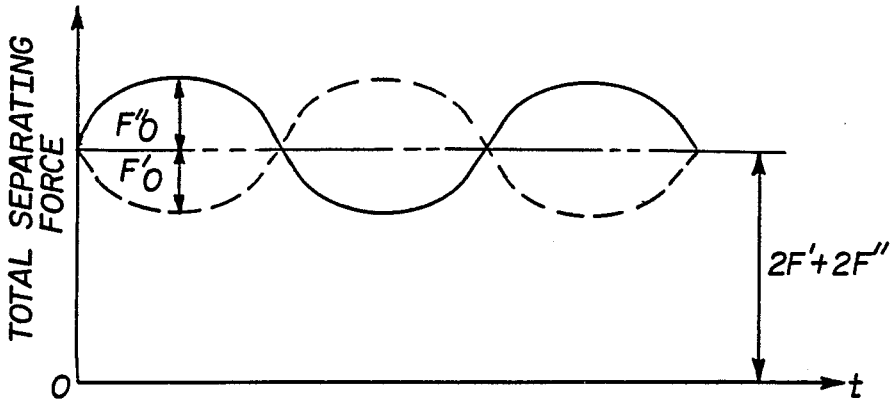
FIGS. 2 and 4 are amplitude and phase curves of the embodiments illustrated in FIGS. 1 and 3, respectively.

FIG. 2 graphically illustrates the important feature of the present invention in applying the oscillations in a manner and degree to elimination detrimental affects of the friction in the piston cylinder assemblies detracting from the operation of the press. In comparing the separating force of the two cylinders sets with time (t) the identical amplitudes and opposite phase relationship of the cylinder sets 16–22, and 18–20 is illustrated. FIG. 2 also shows the $2_F'$ and $2_F''$ values resulting from the normal force reference generator 26 and the valves $F_O'$ and $F_O''$ from the oscillating force reference generator 28.

Figure 3:
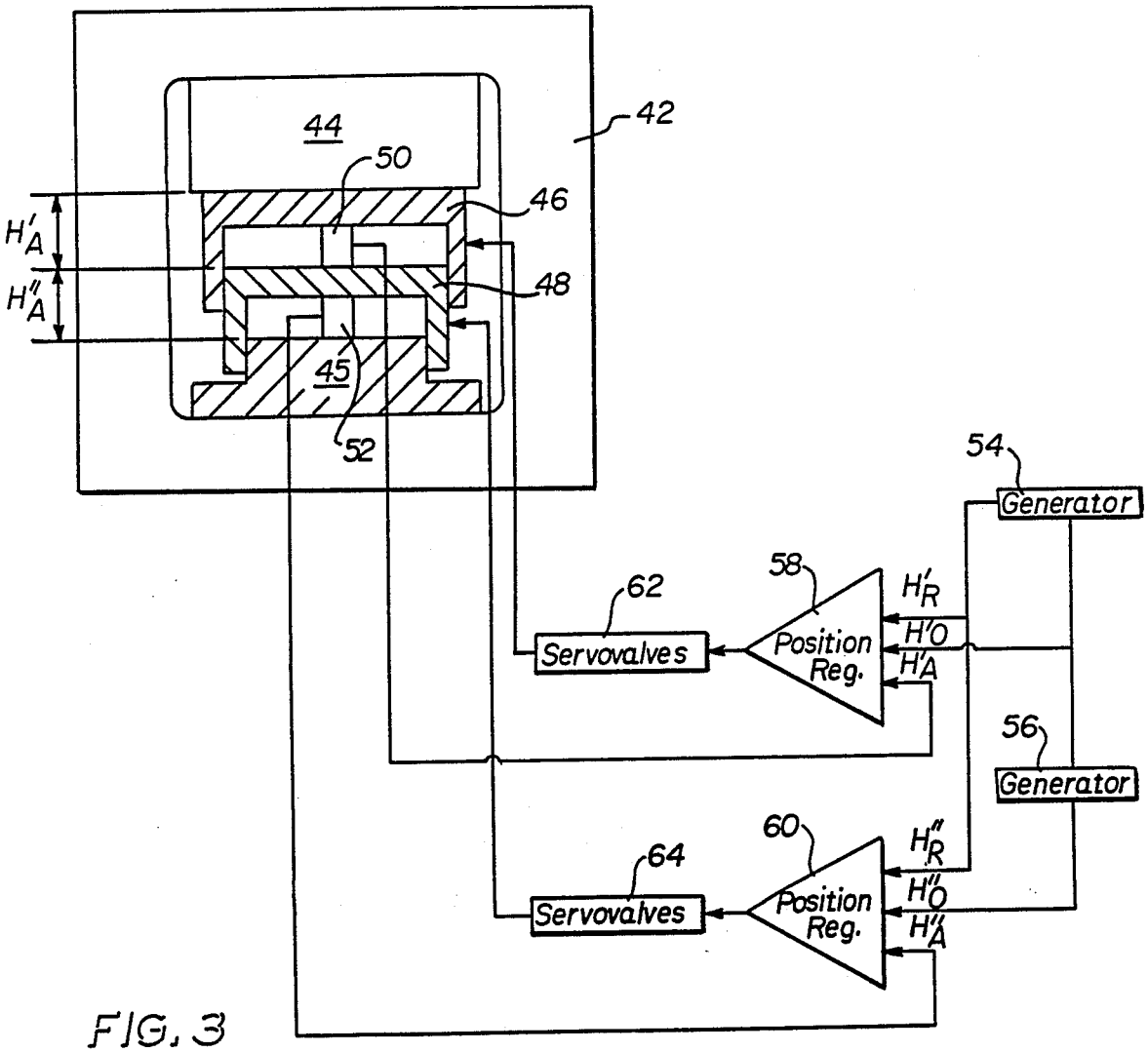
FIG. 3 is a view similar to FIG. 1 of a second embodiment of the present invention.

In referring now to FIG. 3 the press 42 having a moveable platens 44 and 45 is equipped with single acting telescopic piston cylinder assemblies 46 and 48 in place of the four cylinders of FIG. 1. The cylinders 46 and 48 have position transducers 50 and 52, respectively. The control system of FIG. 3 is similar to the control for the press in FIG. 1 except in the case of FIG. 3 the platens are moved to precise positions or a distance relative to each other where in FIG. 1 the platen is subject to a precise force of set to resist a precise force, and consists of a generator 54 for the nominal reference, a generator 56 for the oscillating cylinder position reference, the former producing $H_R'$ and $H_R''$ signals and t he unit 56 signals $H_O'$ and $H_O''$ there signals being received by a position regulators 58 and 60.

The position signal from the regulator 58 controls the piston cylinder assembly 46 while the regulator 60 the piston cylinder assembly 48 through electrohydraulic servovalves 62 and 64, respectively. The control system of FIG. 3 employes the same type of components described in the embodiment illustrated in FIG. 1 and operate in the same manner. The regulators 58 and 60 of the FIG. 3 embodiment receiving the position indicator signals from the position transducers 50 and 52 maintain the equal amplitude and opposite phase relationship the two oscillations, which is similarly accomplished in the embodiment of FIG. 1 by the regulators 30 and 32 receiving the signals from the pressure transducers 34 and 36.

Figure 4:
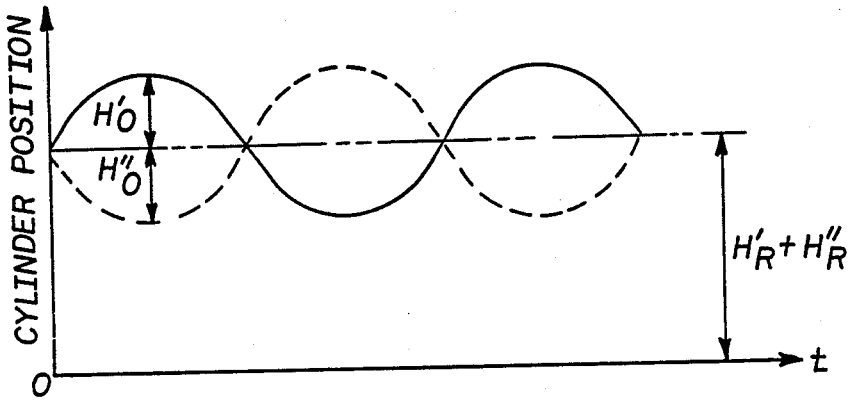

FIG. 4 graphically illustrates the features of the control of FIG. 3. In plotting the cylinder position against time, the horizontal line corresponds to nominal distance between plates 44 and 45 $H_R'+H_R''$. The movement of the platens 44 and 45 is a result of the combined controlled movement of both cylinders 46 and 48 as represented by signals $H_R'$ and $H_R''$. As in the case of FIG. 1 each cylinder have a first oscillation imposed on it as represented by the signals of equal valve $H_O'$ and $H_O''$ of the same amplitude and opposite in phase. As FIG. 4 indicates this will have the effect of not only minimizing the frictional forces in the cylinders i.e. between the pistons and cylinders but accomplish it in a manner that the desired distance between platens will not be disturbed.

While the embodiment of FIG. 1 has been described in connection with a force resisting or applying platen and FIG. 3 as a positioning platen, the cylinder arrangement of each embodiment can be used for either mode. When the embodiment of FIG. 1 is employed to perform the "position" mode, the compression factor of each set of piston rods will be made such as to compress equal amounts in opposite directions to keep the platen 15 in its desired position.

While the invention has been described as applied to a press, as suggested by the aforesaid Russian Patent Publications the invention has immediate application to rolling mills and other similar machines such as rubber and paper machines. With reference to the Russian Patent Publications the present invention can be employed for either or both of the cylinders for moving the rolls of the rolling mill horizontally or vertically.

What I claim is:

1. In a method of operating a machine having a work effecting element, wherein the element is designed to either apply, maintain or re-establish a desired force or assume, maintain or re-establish a desired position and wherein the element is connected to and is moved by at least two fluid actuator means which is subject to internal undesirable affects of friction, the steps comprising:

controlling the flow of fluid to said actuator means to obtain the desired force or position of said element, imposing controlled first oscillations on a said first fluid actuator means in a manner to reduce said frictional forces and, substantially simultaneous with said first oscillations imposing second controlled oscillations on a said second fluid actuator means of substantially the same amplitude and substantially opposite in phase to the first oscillations to reduce the first oscillations disturbing said desired force or position of said element obtained through said actuator means.

2. In a method according to claim 1, wherein said actuator means includes at least two piston cylinder assemblies, the additional steps of:

imposing said first oscillations by operation of a first one of said piston cylinder assemblies, and imposing said second oscillations by operation of the second one of said piston cylinder assemblies.

3. In a method of operating a machine according to claim 2;

wherein the two piston cylinder assemblies are arranged in tandem, the additional steps of producing separate signals representing a position change in each piston cylinder assembly relative to the other piston cylinder assembly, and comparing said separate position signals to produce a control signal for assuring said first and second oscillations will be of the same amplitudes and of opposite phases.

4. In a machine having a work effecting element, wherein the element is designed to either apply, maintain or re-establish a desired force or assume, maintain, or re-establish a desired position and wherein the element is connected to and is moved by at least two fluid actuator means which is subject to internal undesirable affects of friction comprising, means for introducing fluid into said actuator means to cause said movement of said element, means for imposing controlled first oscillations on a said first fluid actuator means in a manner to reduce said frictional forces, and means for substantially simultaneous with said first oscillations for imposing a second controlled oscillations on a said second fluid actuator means of substantially the same amplitude and substantially opposite in phase to the first oscillations to reduce the first oscillations disturbing said desired force or position of said element obtained through said actuator means.

5. In a machine according to claim 4:

wherein said actuator means includes at least two piston cylinder assemblies, said means for imposing said first oscillations including one of said piston cylinder assemblies, said means for imposing said second oscillations including the other of said piston cylinder assemblies.

6. In a machine according to claim 5:

wherein said two piston cylinder assemblies are arranged in tandem, means for producing separate signals representing a position change in each piston cylinder assembly relative to the other piston cylinder assembly, and means for comparing said separate position signals to produce a control signal for assuring said first and second oscillations will be of the same amplitudes and of opposite phases.

* * * * *

UNITED STATES PATENT AND TRADEMARK OFFICE

CERTIFICATE OF CORRECTION

PATENT NO. : 4 757 746

DATED : Jul. 19, 1988

INVENTOR(S) : Vladimir B. Ginzburg

It is certified that error appears in the above-identified patent and that said Letters Patent are hereby corrected as shown below:

Column 1, line 48, "vetween" should read ---between---.

Column 2, line 26, after first "of" delete ---of---.

Column 4, line 32, "of" should read ---or---.

Column 4, line 46 after "52" ---to--- should be inserted.

Column 4, line 55, "plates" should read ---platens---.

Column 4, line 47, after "relationship" insert ---of---.

Column 4, line 60, "valve" should read --value--.

Signed and Sealed this

Thirteenth Day of December, 1988

*Attest:*

DONALD J. QUIGG

*Attesting Officer*

*Commissioner of Patents and Trademarks*